United States Patent [19]

Ohno et al.

[11] Patent Number: 4,806,422

[45] Date of Patent: Feb. 21, 1989

[54] THERMAL TRANSFER (PRINTING) FILM

[75] Inventors: Ken Ohno, Nagahama; Mitsuo Yoshimoto, Hikone; Yoshihide Ozaki, Nagahama, all of Japan

[73] Assignee: Diafoil Company, Limited, Tokyo, Japan

[21] Appl. No.: 62,083

[22] Filed: Jun. 10, 1987

[30] Foreign Application Priority Data

Jun. 11, 1986 [JP] Japan ..... 61-135810

[51] Int. Cl.[4] ..... B41M 5/26

[52] U.S. Cl. ..... 428/336; 428/141; 428/195; 428/341; 428/447; 428/480; 428/488.4; 428/913; 428/914

[58] Field of Search ..... 428/195, 441, 484, 488.1, 428/488.4, 913, 914, 141, 207, 331, 336, 341, 447, 480; 503/227

[56] References Cited

FOREIGN PATENT DOCUMENTS 138483 4/1985 European Pat. Off. ..... 428/488.4
94391 5/1985 Japan ..... 428/488.4
219096 11/1985 Japan ..... 428/488.4

*Primary Examiner*—Ellis P. Robinson
*Assistant Examiner*—P. R. Schwartz
*Attorney, Agent, or Firm*—Oblon, Fisher, Spivak, McClelland & Maier

[57] ABSTRACT

Disclosed herein is a thermal transfer (printing) film comprising:

a base film, a stick-preventing layer provided on one side of said base film, said stick-preventing layer being provided at a rate of 0.01 to 1.9 g/m$^2$ on one side of said base film, the center line average roughness of the surface of said stick-preventing layer being 0.03 to 0.15 $\mu$m, the coefficient of parallel slipping of said stick preventive layer against glass surface being not more than 1.0, and the tensile strength of the film formed with said stick-preventing layer on one side thereof being not less than 8 kgf/mm$^2$ when said film was elongated by 5% in the longitudinal direction, and a heat-melting ink layer provided on the other side of said base film.

9 Claims, No Drawings

THERMAL TRANSFER (PRINTING) FILM

BACKGROUND OF THE INVENTION

The present invention relates to a thermal transfer (printing) film provided with an anti-stick coating film and having excellent transfer performance. More particularly, the present invention relates to a thermal transfer (printing) film comprising a base film having a stick-preventing layer provided (laminated) on one side thereof, the stick-preventing layer being provided at a rate of 0.01 to 1.9 g/m$^2$, the center line average roughness of the stick-preventing layer surface being 0.03 to 0.15 $\mu$m, the coefficient of parallel slipping of the layer against glass surface being not more than 1.0, and the tensile strength of the film formed with the stick-preventing layer on one side thereof being not less than 8 kgf/mm$^2$ when the fiIm is elongated by 5% in the longitudinal direction, and a heat-melting ink layer provided on the other side of the base film.

Various types of printing and recording systems are known, and among them, the thermal transfer (printing) system used for the thermal recording devices such as thermal printers has been popularly used for its excellent operatability and maintenability. In the thermal transfer (printing) system, the heat-melting ink layer provided on one side of the base film of the thermal transfer (printing) film is contacted with the recording paper, and the thermal transfer (printing) film is selectively heated by the thermal head to which pulse signals are transmitted on the side opposite from the ink layer so as to heat this ink layer through the base film to melt the inks and transfer to the recording paper.

In such thermal transfer (printing) system, it is necessary to increase input electric power for reducing input time tc the thermal head in order to attain speed-up of recording, but this has caused the following problem. It is desirable that the heating temperature by the thermal head be adjusted to a level which is below the melting point of he base film but above the melting point of the heat-melting ink layer, but when input electric power is increased, there arises the phenomenon that the base film is fused to the thermal head, whereby the feed of the thermal transfer (printing) film is prevented. This phenomenon is called sticking, and it becomes a cause of drop of recording precision, improper travelling of the film and other troubles.

In order to avoid occurrence of such sticking, a method has been employed in which a stick-preventing layer having higher heat resistance than the base film is provided on the surface of the base film opposite from the heat-melting ink layer.

Provision of such stick-preventing layer on the base film surface can indeed prevent sticking but causes the following problems.

Since the stick preventino layer is positioned together with the base film between the thermal head and the heat-melting ink layer, the heat conductive efficiency form the thermal head to the heat-melting ink layer lowers accordingly. When such heat-conductive efficiency is low there arises the necessity of further increasing input electric power to the thermal head. However, when excessively high input electric power is applied, the heat load given to the stick preventing layer itself also increases to cause wrinkling of the film or generate of the refuse of the stick preventing layer. The generated refuse is accumulated on the thermal head (printing head), thereby adversely affecting transfer precision or causing reverse transfer in the case of color printing, for instance when multiple colors such as yellow, magenta, cyan, etc., are overlapping-printed, that is, a phenomenon that when the different colors are overlapping-printed, the printed inks are taken up by the heated thermal transfer (printing) film.

Under these circumstances, a development of a thermal transfer (printing) film provided with a stick-preventing layer and having excellent heat conductivity as well as excellent transfer performance such as high transfer precision and transfer speed, which would enable transfer with a relatively low input electric power to the printing head has been demanded.

In view of the above, as a result of the present inventors' extensive studies for providing a thermal transfer (printing) film provided with a stick-preventing layer and having excellent transfer performance, it has been found that a thermal transfer (printing) film which has excellent heat conductivity and transfer performance and can well satisfy the above-mentioned requirements, and is provided with a stick preventing layer on one side of a base film and a heat-melting ink layer on the other side thereof, the stick preventing layer being provided at a rate of 0.01 to 1.9 g/m$^2$, the center line average roughness of the stick-preventing layer surface being 0.03 to 0.15 $\mu$m, the coefficient of parallel slipping against the glass surface being not more than 1.0, and the tensile strength of a film formed with the stick-preventing layer on the one side thereof being not less than 8 kgf/mm$^2$ when the film is elongated by 5% elongation in the longitudinal direction and present invention has been attained on the basis of this finding.

SUMMARY OF THE INVENTION

In an aspect of the present invention there is provided a thermal transfer (printing) film comprising:

a base film, a stick-preventing layer provided on one side of said base film, said stick-preventing layer being provided at a rate of 0.01 to 1.9 g/m$^2$ on one side of said base film, the center line average roughness of the surface of said stick-preventing layer being 0.03 to 0.15 $\mu$m, the coefficient of parallel slipping of said stick preventive layer against glass surface being not moer than 1.0, and the tensile strength of the film formed with said stick-preventing layer on one side thereof being not less than 8 kgf/mm$^2$ when said film was elongated by 5% in the longitudinal direction, and a heat-melting ink layer provided on the other side of said base film.

DETAILED DESCRRIPTION OF THE INVENTION

The thermal transfer (printing) film of the present invention is of the structure in which a stick-preventing layer is provided on one side of the base film and a heat-melting ink layer is provided on the other side thereof.

In the present invention, the stick-preventing layer is provided (laminated) on one side of the base film so that the weight of the stick-preventing layer after drying would be in the range of 0.01 to 1.9 g/m$^2$, preferably 0.1 to 0.4 g/m$^2$ If the rate of this stick-preventing layer formed on the base film is less than 0.01 g/m$^2$, no satisfactory stick-preventing effect is provided, and if it is more than 1.9 g/m$^2$, the base film tends to be curled when it is thih. Especially when the hardness of the stick-preventing layer is high, the obtained thermal transfer (printing) film becomes frail, so that it may be broken in the working slittino swarf is produced in abundance during the slitting work, and/or such problems as improper trip of the film at the travelling time, deposition and adhesion of the slitting swarf on the head, etc, are caused.

It is preferable that the stick-preventing layer surface of the film provided with such stick-preventing layer (hereinafter referred to as stick-preventing layer-formed film) is as flat as possible (that is, as small in roughness as possible) since greater flatness allows better heat conduction from the thermal head to the heat-melting ink layer. This is because the air gap between the thermal head and the film surface is reduced when the film is pressed against the thermal head by the platen rubber rolls at the time of printing, and accordingly the drop of heat conducticn due to such air gap is reduced.

For this reason, in the film of the present invention, the center line average roughness of the stick-preventing layer surface should be in the range of 0.03 to 0.15 μm, preferably 0.04 to 0.08μm, at 80 μm cut-off. When the center line average roughness is greater than 0.15 μm, no satisfactory heat conduction can be achieved due to too large air gap. Also, when the center line average roughness is greater than 0.15 μm, although the film travelling. at the time of printing is good and also formation of wrinkles on the film is arrested, there could occur blurring of prints when transfer is conducted at low input electric power. Therefore, there arises the problem that a high level of input electric power is required for preventing such blurring of prints.

On the other hand, when the center line average roughness is less than 0.03 μm, the stick-preventing layer-formed film proves poor in slipperiness and also film workability lowers. When the center line average roughness is less than 0.03 μm, there rareIy occurs blurring of prints even at low-level input electric power and good transferability of the heat-melting ink layer is provided, but because of poor slipperiness of the film as mentioned above, there arise such problems as occurrence of trouble in the working process, improper travelling of the film during printing operations and formation of wrinkles on the film.

In the film of the present invention, the coefficient of slipping the stick-preventing layer surface against the glass surface is not more than 1.0. The running properties of thermal transfer (printing) film can be evaluated by measuring the coefficient of parallel-slipping of the stickpreventing layer surface on a flat and smooth glass surface, and when the measured value exceeds 1.0, trouble in travelling occurs frequently in the actual printing operations, too. It is especially preferable that the coefficient of slipping is not more than 0.6.

In the film of the present invention, the tensile strength thereof at 5% elongation in the longitudinal direction is not less than 8 kgf/mm$^2$. Generally, regarding the strength properties of thermal transfer (printing) film, it is prefeable that the tensile strength in the longitudinal direction is high in view of performing stick-preventing layer coating work, heat-melting ink layer coating work and film slitting work, and film running properties in printer. Especially, tensile strength at the time of lcw-degree elongation is important in relation to elongation of the film or generation of strain as transfer characteristics. For these reasons, the tensile strength of the film at 5% elongation is preferably not less than 8 kgf/mm$^2$ per sectional area of the film including the stick-preventing layer.

From the view point of heat conduction from the printing head to the heat-melting ink layer, it is preferable that the stick-preventing layer-formed film is as small in thickness as possible, usually $^2$ to 12 μm, preferably 3 to 7μm.

In the present invention, the center line average roughness of the surface of the stick-preventing layer-formed side of the base film is preferably in the range of 0.03 to 0.15 μm at 80 μm cut-off. In case a stick-preventing layer is provided thinly and flatly, the surface protuberances of the base film affect the surface flatness of the stick-preventing layer, that is, they enlarge the roughness of the stick-preventing layer surface and invite a reduction of heat conduction due to air gap. Therefore, it is preferable that the surface roughness of the stick-preventing layer-formed side of the base film is also defined to fall within the said range.

The tensile strength of the stick-preventing layer-formed film of the present invention is not less than 8 kgf/mm$^2$ at 5% elongation in the longitudinal direction as mentioned above. The tensile strength of the stick-preventing layer is very low in comparison with that of the base film, so that eventually it is preferable that the tensile strength of the base film at 5% elongation in the longitudinal direction is also not less than 8 kgf/mm$^2$.

As the base film, ordinarily used heat-resistant films such as polycarbonate film, polyethylene naphthalate film, etc., can be employed in the present invention, but polyester film such as biaxially oriented polyethylene terephthalate film is preferred for providing sufficient strength and heat-resistance even with a small thickness.

The constituents of such thermal transfer (printing) film of the present invention will be described in detail below.

The center line average roughness of the base film surface is adjusted by blending the fine particles of inert compounds in the raw polymer used for film forming. In this case, when using, for example, polyethylene terephthalate, polyethylene naphthalate or the like, there can be employed a particle deposition method in which a phosphorus compound or such is reacted with the metallic compound dissolved in the reaction system when producing the polymer, for example the metallic compound dissolved in the system after ester interchange reaction, thereby depositing out the fine particles of the compound, and a particle addition method in which the inert fine particles are added at any proper stage in the process from the polymer producing step to the extrusion step before film forming. As the particles to be added in the particle addition method, there can be used the fine particles of one or more materials selected from kaolin, talc, magnesium carbonate, calcium carbonate, barium carbonate, calcium sulfate, barium sulfate, lithium phosphate, calcium phosphate, magnesium phosphate, aluminum oxide, silicon oxide, titanium oxide, carbon black and the like. For obtaining the preferred surface roughness of the base film of the present invention, the particles added have an average particle size (diameter) of usually 0.1 to 10 μm, preferably 0.3 to 3 μm. The amount of the particles blended is 0.01 to 3.0% by weight, preferably 0.1 to 1.5% by weight, based on the base film.

The tensile strength of the base film can be adjusted by properly selecting the film stretching conditions after extrusion and the heat-setting conditions. For example, in the case of polyester film, its strength is set according to the stretching temperature, stretch ratios, etc., in the production of biaxially stretched film produced by heating the melt extruded amorphous sheet at a temperature of 70 to 130° C, stretching the sheet in the both longitudinal (machine) and transverse directions at the predetermined ratios and heat-setting the stretched film at 200° to 230° C. Therefore, for increasing the strength in the longitudinal direction, it is advantageous to orient the molecular chains more in the longitudinal direction than in the transverse direction by stretching. In the present invention, in order to provide the base film having a tensile strength of not less than 8 kgf/mm$^2$ at 5% elongation in the longitudinal direction, for example, it is prefered to conduct the biaxial stretching treatment at a stretch ratio of 2 to 7 in both of the longidudinal and transverse directions.

In order that the center line average roughness and the coefficient of parallel slip of the stick-preventing layer-formed on the base film surface may fall in the defined range of the present invention, it is effective to contain the organic or inorganic particles in the stick-preventing layer. As for the particle size of these particles, it is desirable that the average particle diameter (r) thereof is specified as:

$$r-t \leqq 0.5\ \mu m$$

wherein t is thickness of the stick-preventive layer and r is an average particle diameter. When the average diameter (r) of the particles is too large, particularly in case the stick-preventing layer is thin, there are produced the protuberances of particles on the layer surface, which tends to cause a drop of heat conduction due to air gaps. Especially in case the stick-preventing layer is thin, the average diameter of the particles is preferably not greater than 0.5 μm.

The content of the particles is preferably not more than 10% by weight based on the stick-preventing layer. Especially, in case the particles of greater than 0.1 μm in diameter are contained in an amount of more than 10% by weight in the stick-preventing layer, there is a higher tendency to cause a drop of heat conduction due to air gaps because of agglomeration of the particles, so that it is preferable that the content of the particles be properly selected from the range of not more than 10% by weight in consideration of the average particle diameter, the thickness of the stick-preventing layer and other matters.

As for the stick-preventing layer in the film of the present invention, it is appropriate to use a cured or dried coating film mainly composed of one or more members selected from the group consisting of alkoxysilane hydrolyzates, melamine resins, silicon polymers, silicon graft polymers, silicon functional silyl isocyanates, solvent-soluble polyimide resins and solvent-soluble polyparabanic acid resins.

Among these component materials of the stick-preventing layer, the alkoxysilane hydrolyzates comprise alkoxysilanes of the general formula:

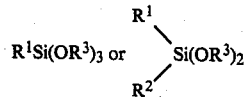

wherein $R^1$ and $R^2$ represent substituted or unsubstituted monovalent hydrocarbon groups such as alkyl group, cycloalkyl group, alkenyl group, aryl group, aralkyl group or those groups in which hydrogen atoms are partly substituted with other substituents such as mercapto group, glycidoxyl group, metaacryloxyl group, amino group, etc., and $R^3$ represents alkyl group. Typical examples of these alkoxysilanes are methyltrimethoxysilane, methyltriethoxysilane, methyltripropoxysilane, ethyltrimethoxysilane, vinyltrimethoxysilane, phenyltrimethoxysilane, 3-aminopropyltrimethoxysilane, 3-mercaptopropyltrimethoxysilane, dimethyldimethoxysilane and the like.

Hydrolysis of these alkoxysilanes is carried out preferably in a lower alcohol solvent such as ethanol and isopropanol in the presence of an inorganic or organic acid usually used for hydrolysis. Colloidal silica may be coexisted with the hydrolyzate. In this case, the addition of colloidal silica may be conducted before, during or after the hydrolysis thereof, but generally it is preferably conducted before the hydrolysis of alkoxysilane. The ratio of colloidal silica added, based on the amount of alkoxysilane used is selected from within the range of 0–80% by weight (preferably 20–80% by weight) of colloidal silica (calculated as silica solid) to 100–20% by weight (preferably 80–20% by weight) of alkoxysilane. As colloidal silica, Ludox (E.I. du Pont de Nemours and Co.), Syton (Monsantc Co.), Nalcoag (Nalco Chemical Co.), Snowtex (Nissan Kagaku Kogyo K.K.) and the like can be favorably used.

In case of using a coating material containing such alkoxysilane hydrolyzate, the curing treatment thereof after coating on the base film is preferably conducted by heating the coat in the presence of a curing catalyst such as acetic acid, sodium acetate, alkali metal salts of fatty acids, quaternary ammonium salts, etc. It is usually effective to carry out the curing treatment at an atmosphere temperature of 60° to 150° C. for a period of not less than 8 seconds, preferably 10 to 60 seconds, although these conditions are variable epending on the thickness of the coat film. The coat film can be cured to an even higher degree if the curing treatment is conducted for a longer time such as several ten minutes, but there is no nced cf elongating the period of curing treatment for attaining the purpose of the present invention. It is supposed that a chemical bond relation is produced between alkoxysilane hydrolyzate and colloidal silica in the formed coat film.

Melamine resin used in the present invention is selected from those whose main constituent is etherified melamine resin obtained by using melamine, formaldehyde and alcohol (such as butanol), or alkylated melamine resin obtained by using melamine, formaldehyde and alkyl phosphate (such as butyl phosphate). Butanol-modified etherified melamine resin or butylated melamine resin is preferred.

In case of using melamine resins, a two-component system consisting essentially of such melamine resins and a drying oil- or non-drying oil-based alkyd resins, a three-component system consisting essentially of the melamine resins, urea resins and an alkyd resins, a mixture of the melamine resins and nitrocellulose are preferably used as coating material in providing high coat hardness, flexibity and adhesiveness. In case of using other integrally curable resin such as alkyd resins, the ratio (by weight) of such resins to melamine resins is preferably 0.1–10 to 1.

In application of such coating material mainly composed of melamine resins, a curing catalyst such as paratoluenesulfonic acid, acetamide, triethanolamine, alkyl titanate, sulfanilic acid, etc., is used for accelerating the curing reaction.

In case of forming a complex of melamine resin and alkoxysilane hydrolyzate, the amount ratio of alkoxysilane hydrolyzate to melamine resin is 1:0–50, preferably 1:0.1–10 by solid weight ratio. When the ratio of alkoxysilane hydrolyzate is higher than the range, although the formed coat film has good heat resistance, the adhesiveness of the coat film to the base film deteriorates.

In case of using other resins such as alkyd resin with melamine resin, the ratios of the respective components such as alkoxysilane hydrolyzate, melamine resin and alkyd resin are properly selected in accordance with the use properties. As examples of such component systems, "NSC-5290" made by Nippon Fine Chemical Co., Ltd. and "Si-Coat 727" made by Daihachi Chemical Co., Ltd. may be exemplified.

As silicon copolymer resin, there can be used copolymers of siloxane structure having a functional group and alkyd resin, epoxy resin, melamine resin or the like. Especially, silicon-modified alkyd resins are preferred. Among these copolymers, "KS-723A/KS-723B", "950-A2", etc., made by Shin-etsu Kagaku Kogyo K.K. are the ones which can be favorably used in the present invention. Other analogous preparations such as silicon elastomers "SP-1020", "SP-6020", "SP-1101", copolymerized silicon polymer "SP-105V", etc., made by Dainichiseika Color & Chemicals Mfg. Co., Ltd. are also usable.

Polymers of acrylic esters or methacrylic esters can be mentioned as acryl chain component of acryl-silicon graft polymer used as silicon graft polymer resin in the present invention. As ester group of the esters, saturated hydrocarbon groups such as methyl, ethyl, n-propyl, isopropyl, n-butyl, isobutyl, 1-methylpropyl, 2-ethylbutyl, n-pentyl, n-hexyl, 2-ethylhexyl, n-heptyl, n-octyl, nonyl, decyl, lauryl, stearyl, etc.; unsaturated hydrocarbon groups such as 2-methyl-2-butenyl, 3-methyl-2-butenyl, 3-methyl-3-pentenyl, etc.; hydroxy-alkyl groups such as hydroxyethyl, hydroxypropyl, etc.; halogenated alkyl groups such as chloromethyl, 1-chloroethyl, 2-bromoethyl, etc; alkoxyalkyl groups such as methoxyethyl, ethoxyethyl, etc.; aminoalkyl groups such as 2-dimethylaminoethyl, 2-diethylaminoethyl, etc.; cycloalkyl groups such as cyclohexyl, etc.; phenyl groups; benzyl groups; tetrahydrobenzyl groups; glycidyl groups may be exemplified. Copolymers of $\alpha,\beta$-ethyleneic unsaturated monomers such as acrylamide, methacrylamide, N-methylol-acrylamide, N-methylolmethacrylamide, styrene, vinyltoluene, etc., are also usable as acryl chain component.

As the silicon chain component, the polymers having an alkylpolysiloxane structure such as dimethylpolysiloxane can be used.

The copolymerization ratio of these acryl component and silicon component is not critical in the present invention, but usually a higher ratio of acryl component than silicon component is preferred in terms of hardness and adhesiveness of the coating film. Typically, an acryl to silicon component ratio of 6–9.5:4–0.5, especially 8–9.5:2–0.5 is preferred.

As the acryl-silicon graft polymer produced by graft-copolymerizing acryl component and silicon component "ARON GS-30" made by Toagosei Chemical Industry Co., Ltd. can be mentioned as a typical example, but other polymers such as a thermoplastic acryl-silicon graft polymer, an acryl-silicon graft polymer obtained by reacting the hydroxyl group added to the acryl component with isocyanate resin in the presence of a curing accelerator such as dibutyltin dilaurate and crosslinking them under heating, and thc an acryl-silicon graft polymer crosslinked by using a silane coupling agent are also usable.

Silicon-functional silyl isocyanates usable in the present invention include alkylsilyl isocyanates, alkoxysilane isocyanates, tetraisocyanates, etc. These isocyanates are self-condensed or reacted with other components to form a coating film. Typical examples of these silicon-functional silyl isocyanates are trimethylsilyl isocyanate, dimethylsilyl diisocyanate, methylsilyl triisocyanate, vinylsilyl isocyanate, phenylsilyl triisocyanate, tetraisocyanate silane, and ethoxysilane triisocyanate.

As the solvent-soluble polyimide polymer used in the present invention, "XU-218" made by Ciba Geigy Ltd. can be mentioned as a typical example. This is a diaminophenylindane-based polyimide polymer, and as compared with the ordinary polyimide resins which, after coating, need to be made into a polymer by reacting under a high temperature, "XU-218" has the advantage in that a coating film can be formed by merely applying and drying the polymer solution.

Polyparabanic acid resin of the solvent-soluble polyparabanic acid polymer is represented by the following formula:

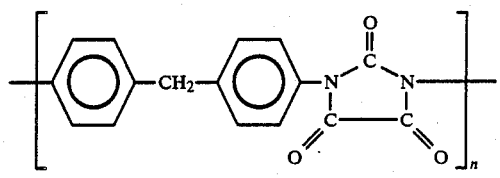

Like polyimide polymer, this resin has excellent heat resistance and is capable of forming a coating film by merely applying its solution and drying it.

When applying the polyimide polymer or polyparabanic acid polymer to form a thin base fiom, it is preferable to apply it to a coating weight of not more than 0.5 g/m$^2$ by using a dimethyl formamide (DMF)/toluene or DMF/toluene/methyl ethyl ketone (MEK) mixed solvent.

Any of the above-mentioned component resins of stick-preventing layer has excellent heat resistance and also, in use thereof, there is caused little ink repellency by the blooming component in the course of heat-melting ink coating, which is seen when using the conventional straight-chain alkylpolysiloxane type silicon resins or oils thereof such as dimethylpolysiloxane silicon resin or oil thereof. Further, the resins have the advantage that they can afford a pertinent slipping properties to the coat film.

When forming the stick-preventing layer in accordance with the present invention, in order to make best use of their properties, these resin components may be used in the form of a blend or after integrally curing them to form a coating film. In this case, when forming the coating solution, it is preferable to use a solvent in which all of the resin components are soluble.

Further, an antistatic agent may be added for reducing the static properties of the coating film. Polyether-modified silicon oil is preferably used as such antistatic agent. Alkylaralkylpolyether-modified silicon oil, epoxy/ polyether-modified silicon oil, hydrophilic alcohol-modified silicon oil and the like are also usable. Paintable silicon oils such as alkylallyl-modified silicon oil, methylstyrene-modified silicon oil and olefin-modified silicon oil can be also added as a favorable heat-resistant lubricant component as these oils can afford lubricity to the coating film and also have little ink repellency.

In some cases, it is effective to add a heat-resistant surfactant such as sodium alkylsulfonate. The amount of such surfactant added is preferably 0.5 to 15% by weight as the content in the coating film. Too high content of such surfactant invites a reduction of adhesiveness of the coating film, curability or ink adhesiveness.

In the thermal transfer (printing) film of the present invention, the heat-melting ink in the heat-melting ink layer formed on the other side of the base film is prepared by properly blending the materials heat-softenable at low temperatures of waxes such as paraffin wax, carnauba wax, microcrystalline wax, beeswax, white wax, etc., polybutene, low molecular-weight polyethylene, polyvinyl acetate, polyvinylbutyral, various kinds of modified maleic acid resins, ethylene-vinyl acetate copolymer resin and various kinds of thermoplastic acrylic resins thereto, further adding carbon black or various kinds of pigment or dye for providing the desired coloration thereto, and kneading them under heating so that the prepared heat-melting ink will have a heat-softening point and a transfer quality relevant to the printer used.

The prepared heat-melting ink is coated on the base film by a hot-melt coater (flexo, gravure or smoothing bar coating) or, if it is solvent-soluble type, its solvent solution is coated on the base film by a suitable coater such as gravure coater and dried to form a heat-melting ink layer. The coating weight of the ink is properly decided according to the required transfer density, transfer quality, etc., but usually it is 1 to 6 g/m$^2$, preferably 3 to 5 g/m$^2$, The thermal transfer (printing) film of the present invention has the following advantages:

(1) Since the stick-preventing layer is provided at a rate of 0.01 to 1.9 g/m$^2$, an excellent anti-stick effect is produced and further the problem of curling or deterioration of the film is eliminated.

(2) Since the center line average roughness of the stick-preventing layer surface is 0.03 to 0.15 μm, the trouble in working operations due to drop of heat conduction by air gap or deterioration of slipperiness of the film, and other problems such as worsening of running properties at the time of printing, formation of wrinkles on the film, etc., are eliminated.

(3) Since the coefficient of parallel-slipping of the stick-preventing layer surface against the glass surface is not more than 1.0, the film has good running properties.

(4) Since the tensile strength of the stick-preventing layer-formed film at 5% elongation in the longitudinal direction is not less than 8 kgf/mm$^2$, the workability and running properties of the film are excellent.

The transfer film of the present invention can be produced with very excellent workability and enables high-speed and high-precision thermal transfer with excellent transfer performance without giving rise to such problems as curling, film wrinkling, blurring of prints, sticking, etc.

Thus, the thermal transfer (printing) film of the present invention has extremely high industrial utility.

The present invention will hereinafter be described in more detail by showing the examples and comparative examples, but it is to be understood that the present invention is not limited to the examples shown below but can be embodied otherwise without departing from the spirit and scope of the invention.

In the following Examples and Comparative Examples, the determinations and evaluations of the properties were made according to the following methods.

(1) Center line average roughness (Ra)

Measured according to the method of JIS B-0601 under the following conditions: radius of feeler end=5 μm, load=30 mg, cut-off=80 μm, scanning speed=0.1 mm/sec, standard length=2.5 mm.

(2) Film thickness

Measured by the 10-fold lap method according to JIS C-2318.

(3) Tensile strength at 5% elongation (F5)

Tensile load at 5% elongation of the film was detected under the conditions of 20° C., 65% RH, test piece width of 15 mm, tensile tester-chack interval of 50 mm, and rate of pulling of 200 mm/min, and the tensile strength at 5% elongation of the film was determined from the formula:

$$F_5\ (kgf/mm^2) = \frac{\text{tensile load at 5\% elongation}}{\text{sectional area of sample before test}}$$

(4) Glass surface/stick-preventing layer parallel-slipping coefficient (μ)

A test film of 15 mm in width and about 100 mm in length was placed on a mirror-finished glass plate ("End-ground slide glass" made by Takahashi Giken Glass Co., Ltd., measuring about 1.4 mm in thickness, about 26 mm in width and about 76 mm in length) which had its surface cleaned with solvent and dried. A silicon rubber plate of 10 mm square and 4 g in weight was placed on the test piece, and a load of 100 g was applied onto the rubber plate. An end of the test film was connected to a U gage by a connecting jig, and this test piece and the glass plate were slided relative to each other in the opposite directions parallel and horizontally at a rate of 20 mm/min, the load (FS) being detected by the U gage. The test was conducted under the conditions of 20° C. and 65% RH, and the coefficient of parallel-slipping was determined from the following formula:

$$\mu = \frac{\text{average horizontal tensile load } (FS) \text{ in 1-3 mm movement of test piece}}{\text{vertical load applied}} = \frac{FS(g)}{104(g)}$$

(5) Coating weight after dried

Shown by average coating weight calculated from the following formula:

$$\text{Coating weight } (g/m^2) = \frac{\text{amount of coating material used (g)} \times \text{solid ratio of coating material}}{\text{coated area } (m^2)}$$

(6) Coating and slitting workability evaluation standard:

++: Coating and take-up workability of the stick-preventing layer-formed film, coating and take-up workability of the heat-melting ink, and fine slitting workability of the ink-coated film were good.

+: The take-up workabilities were not so good but in the acceptable range.

−: The take up workabilities were poor, and there were observed such troubles as wrinkling of the film, break of the film and generation of slitting swarf.

(7) Curling evaluation standard:

++: There was seen no trouble due to curling of the film in the course of coating and slitting work.

+: A little trouble due to curling was observed but it was not much injurious to use of the film.

−: The film was curled strongly, and there occured many troubles due to curling in the course of coating and slitting work. Also, curl remained on the ink-coated film after slitting and became a hindrance to printing operation.

(8) Evaluation standard for wrinkling during printing:

++: The film remained free of wrinkles during printing by a printer.

+: Slight wrinkling was observed but it caused no trouble in printing operation.

−: The film was wrinkled during printing by a printer.

(9) Blurring evaluation standard:

The printing characteristics were evaluated by carrying out printing with a thermal printer mfd. by Matsushita Electronic Components Co., Ltd., by changing the applied voltage (V) in a solid black mode under the following conditions: thermal head resistivity (R)=275 Ω, pulse width=1.5 m sec, printing head pressure=1.5 kg. Ordinary paper and polyester film (75 μm) for OHP (Over Head Projector) were used as recording paper. The following ranking was made from the state of blurring of prints with $W=V^2/R$ ($V^2/\Omega$) as an index.

++: The degree of blurring was not more than 0.60 in W value, and good prints were obtained.

+: The degree of blurring was more than 0.6 to not more than 0.70 in W value, and the prints were in the acceptable range.

−: The degree of blurring exceeded 0.70 in W value and the prints were bad.

−−: Sticking occured, and evaluation of blurring was impossible.

(10) Sticking evaluation standard:

The following ranking was made from the state of sticking in the above print blurring test.

++: The degree of sticking was not less than 0.70 in W value, and printing could be conducted smoothly.

+: The degree of sticking was not less than 0.6 to less than 0.7 in W value, and the prints were in the acceptable.

−: The degree of sticking was less than 0.60 in W value, and printing was hampered.

EXAMPLES 1-9 and COMPARATIVE EXAMPLES 1-6

Biaxially oriented polyester films of the properties shown in Table 1 were used as base film. Each of the anti-stick coating solutions shown in Table 1 was applied on one side of the base film to a coating weight (after drying) shown in Table 1 to form a stick-preventing layer of the properties shown in Table 1 (no such layer was formed in Comparative Example 6). Then a heat-melting ink composed of carnauba wax, paraffin wax, low-molecular weight polyethylene, lubricant blend and carbon black as colorant was coated on the other side of each of the stick-preventing layer-formed films to a coating weight of about 4 g/m² to form a heat-melting ink layer, thereby obtaining the thermal transfer (printing) films K-1 to K-9, and H-1 to H-6.

The properties of the obtained thermal transfer (printing) films are shown in Table 2.

The anti stick coating solution Nos. 1-1 to 1-9, 2-1 and 2-2 in Table 1 were of the formulations shown below. In the following description, coating solution "A" is a coating solution prepared by mixing 60 parts by weight of methyltrimethoxysilane, 80 parts by weight of colloidal silica (a 30 % solution of "Snowtex" produced by Nissan Kagaku K.K.) and 1.5 parts of acetic acid, stirring and cooling the mixture in an ice bath, further mixing under stirring 100 parts by weight of isopropyl alcohol and 2.5 parts by weight of acetic acid, allowing the mixture to stand at room temperature for 7 days for aging and hydrolyzing the mixture.

| | |
|---|---|
| 1-1 | |
| Coating solution "A" (adjusted to 20% solid content) | 100 parts by weight |
| Polyether-modified silicon oil ("KF 352" made by Shin-etsu Kagaku Kogyo K.K.) | 1.5 parts by weight |
| Diluent (MEK/methyl cellosolve/toluene/methanol mixture) | required parts |
| 1-2 | |
| Alkoxysilane hydrolyzate/melamine resin solution (30% solid content) "Si-Coat 727" made by Daihachi Kagaku Kogyo K.K.) | 100 parts by weight |
| Silicon-modified resin solution ("KS 723B" made by Shin-etsu Kagaku Kogyo) | 1 part by weight |
| Diluent (MEK/methyl cellosolve/toluene/methanol mixed solution) | required parts |
| 1-3 | |
| 0.1 part by weight of benzoguanamine resin ("Epostar S" made by Nippon Shokubai Kagaku Kogyo K.K., average particle diameter: 0.3 μm) was added to the formulation of 1-2. | |
| 1-4 | |
| Mixture of alkoxysilane hydrolyzate and melamine resin (30% solid content) ("NSC-5290" made by Nippon Fine Chemical Co., Ltd.) | 100 parts by weight |
| Polyether-modified silicon oil ("DKQ8-779" made by Dow Corning Ltd.) | 2 parts by weight |
| "Epostar S" | 1 part by weight |
| Diluent (MEK/methyl cellosolve/toluene/methanol mixed solution) | required parts |
| 1-5 | |
| Silicon-alkyd copolymer resin solution | |
| "KS-723A" (made by Shin-etsu Kagaku Kogyo K.K.) | 100 parts by weight |
| "KS-723B" (made by Shin-etsu Kagaku Kogyo K.K.) | 25 parts by weight |
| "PS-3" (catalyst) (made by Shin-etsu Kagaku Kogyo K.K.) | 5 parts by weight |
| Diluent (MEK/toluene mixed solution) | required parts |
| 1-6 | |
| Coating solution "A" (20% solid content) | 80 parts by weight |
| Silicon-acryl graft polymer solution ("GS-30" made by Toagosei Chemical Industry Co., Ltd.) (20% solid content) | 20 parts by weight |
| Sodium alkylsulfonate solution ("MKE-136" made by Takemoto Yushi K.K.) (50% solid content) | 1 part by weight |
| Diluent (MEK/methyl cellosolve/toluene/methanol mixed solution) | required parts |
| 1-7 | |
| Silyl isocyanate solution ("Orgatix SIC-003" made by Matsumoto Seiyaku Kogyo K.K.) | 100 parts by weight |

-continued

| | |
|---|---|
| (10% solid content) | |
| Diluent (MEK/toluene mixed solution) | required parts |
| 1-8 | |
| Polyimide resin polymer ("XU-218" made by Ciba Geigy Ltd.) | 70 parts by weight |
| "Si-Coat 727" | 30 parts by weight |
| Diluent (DMF/THF/toluene mixed solution) | required parts |
| 1-9 | |
| Polyparabanic acid resin polymer solution ("XT-1" made by Nitto Kagaku Kogyo K.K.) (21% solid content) | 100 parts by weight |
| "KS-723B" | 0.5 parts by weight |
| "Epostar S" | 0.25 parts by weight |
| Diluent (DMF/THF/toluene mixed solution) | required parts |
| 2-1 | |
| "Si-Coat 727" | 100 parts by weight |
| Diluent (MEK/toluene) | required parts |
| 2-2 | |
| 3 parts by weight of benzoguanamine resin ("Epostar M" made by Nippon Shokubai Kagaku Kogyo K.K., average particle diameter: 1–2 μm) was added to the formulation of 1-1. | |

It is apparent from Table 2 that the thermal transfer (printing) films K-1 to K-9 according to the present invention have very excellent transfer performance.

On the other hand, among the films of the Comparative Examples, H-1 and H-4 have the problems of blurring of prints because of the too large value of Ra of the stick-preventing layer-formed film, while H-3, which is too small in Ra, has the problems in workability, wrinkling and sticking due to defective slipping characteristics. H-2 is too small in the value of $F_5$ of the stick-preventing layer-formed film, so that this film is curled greatly and poor in nerve strength, workability and printability. H-5 and H-6 are poor in anti-stick properties as they are too small in the rate of stick-preventing layer on the base film or have no anti-stick layer.

TABLE 1

| | Base film | | | | Stick-preventing layer | | | | Stick preventive layer-formed film | | | | | |
|---|---|---|---|---|---|---|---|---|---|---|---|---|---|---|
| | | | | | | Particles added | | | | | | | | |
| | Thickness (μm) | Ra (μm) | $F_5$ in longitudinal direction (kgf/mm²) | $F_5$ in transverse direction (kgf/mm²) | Coating solution No. | Amount added (%) | Av. particle diameter (μm) | Coating weight (g/m) | Thickness (μm) | Ra (μm) | μ | $F_5$ in longitudinal direction (kgf/mm²) | Coating weight of ink (g/m²) | Thermal transfer film No. |
| EXAMPLES | | | | | | | | | | | | | | |
| 1 | 6.0 | 0.06 | 11 | 10 | 1-1 | — | — | 0.15 | 6.2 | 0.06 | 0.1 | 11 | 4 | K-1 |
| 2 | 5.2 | 0.05 | 12 | 10 | 1-2 | — | — | 0.20 | | 0.05 | 0.4 | 11 | 4 | K-2 |
| 3 | 4.5 | 0.06 | 13 | 11 | 1-3 | 0.3 | 0.3 | 0.20 | | 0.06 | 0.1 | 12 | 4 | K-3 |
| 4 | 5.2 | 0.05 | 12 | 10 | 1-4 | 3 | 0.3 | 0.20 | | 0.06 | 0.1 | 11 | 4 | K-4 |
| 5 | 6.0 | 0.06 | 11 | 10 | 1-5 | — | — | 0.10 | | 0.06 | 0.1 | 11 | 4 | K-5 |
| 6 | 6.0 | 0.06 | 11 | 10 | 1-6 | — | — | 0.25 | | 0.07 | 0.2 | 10 | 4 | K-6 |
| 7 | 6.0 | 0.06 | 11 | 10 | 1-7 | — | — | 0.20 | | 0.06 | 0.1 | 10 | 4 | K-7 |
| 8 | 5.2 | 0.05 | 12 | 10 | 1-8 | — | — | 0.10 | | 0.05 | 0.2 | 12 | 4 | K-8 |
| 9 | 5.2 | 0.05 | 12 | 10 | 1-9 | 1 | 0.3 | 0.10 | | 0.06 | 0.1 | 12 | 4 | K-9 |
| COMPARATIVE EXAMPLES | | | | | | | | | | | | | | |
| 1 | 6.2 | 0.18 | 11 | 10 | 1-1 | — | — | 0.15 | | 0.17 | 0.2 | 11 | 4 | H-1 |
| 2 | 5.2 | 0.05 | 9 | 9 | 1-1 | — | — | 2.0 | | 0.05 | 0.3 | 7 | 4 | H-2 |
| 3 | 5.2 | 0.03 | 12 | 10 | 2-1 | — | — | 0.20 | | 0.02 | 1.5 | 12 | 4 | H-3 |
| 4 | 6.0 | 0.06 | 11 | 10 | 2-2 | 13 | 1~2 | 0.20 | | over than 0.3 | 0.1 | 10 | 4 | H-4 |
| 5 | 6.0 | 0.06 | 11 | 10 | 1-1 | — | — | 0.008 | | 0.06 | 0.2 | 11 | 4 | H-5 |
| 6 | 6.0 | 0.06 | 11 | 10 | — | — | — | — | | — | — | — | 4 | H-6 |

TABLE 2

| | Film No. | Coating and slitting workability | Curling | Wrinkling during printing | Blurring of prints | Sticking | Judgment |
|---|---|---|---|---|---|---|---|
| EXAMPLES | | | | | | | |
| 1 | K-1 | ++ | ++ | + | ++ | + | OK |
| 2 | K-2 | ++ | ++ | + | ++ | ++ | OK |
| 3 | K-3 | ++ | ++ | ++ | ++ | ++ | OK |
| 4 | K-4 | ++ | ++ | ++ | ++ | ++ | OK |
| 5 | K-5 | + | ++ | + | ++ | ++ | OK |
| 6 | K-6 | ++ | ++ | + | ++ | + | OK |
| 7 | K-7 | ++ | ++ | + | ++ | + | OK |
| 8 | K-8 | + | + | + | ++ | ++ | OK |
| 9 | K-9 | + | + | ++ | + | ++ | OK |
| COMPARATIVE EXAMPLES | | | | | | | |
| 1 | H-1 | ++ | ++ | + | − | ++ | NG |
| 2 | H-2 | − | − | + | + | ++ | NG |

TABLE 2-continued

| | Film No. | Coating and slitting workability | Curling | Wrinkling during printing | Blurring of prints | Sticking | Judgment |
|---|---|---|---|---|---|---|---|
| 3 | H-3 | − | ++ | − | −− | − | NG |
| 4 | H-4 | + | ++ | ++ | − | ++ | NG |
| 5 | H-5 | ++ | ++ | − | −− | − | NG |
| 6 | H-6 | ++ | ++ | − | −− | − | NG |

What is claimed is:

1. A thermal transfer printing film comprising:

(a) a base film, (b) a stick-preventing layer provided on one side of said base film, said stick-preventing layer being provided at a rate of 0.01 to 1.9 g/m$^2$ on one side of said base film, the center line average roughness of the surface of said stick-preventing layer being 0.03 to 0.15 μm, the coefficient of parallel slipping of said stick preventive layer against a glass surface being not more than 1.0, the tensile strength of the film formed with said stick-preventing layer on one side thereof bering not less than 8 kgf/mm$^2$ when said film was elongated by 5% in the longitudinal direction, and said stick-preventing layer being a cured or dried coating film mainly composed of one or more alkoxysilane hydrolyzates produced by hydrolyzing an alkoxysilane represented by the following formula:

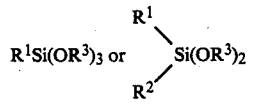

wherein $R^1$ and $R^2$ each represent substituted or unsubstituted monovalent hydrocarbon groups of an alkyl group, cycloalkyl group, alkenyl group, aryl group, aralkyl group or those groups in which hydrogen atoms thereof are partly substituted with other substituents being a mercapto group, glycidoxyl group, methacryloxyl group, amino group; and $R^3$ represents an alkyl group, and (c) a heat-melting ink layer provided on the other side of said base film.

2. The thermal transfer printing film according to claim 1, wherein the base film is a biaxially oriented polyester film.

3. The thermal transfer printing film according to claim I, wherein the stick-preventing layer contains not more than I0% by weight of surface roughening particles having an average particle diametr (r) defined by the following formula:

$$r-t \leqq 0.5\ m$$

wherein t is the thickness of the stick-preventing layer.

4. The thermal transfer printing film according to claim I, wherein the center line average roughness of the surface of the base film on its stick-preventing layer formed side is 0.03 to 0.15 μm, and the tensile strength of said base film at 5% elongation thereof in the longitudinal direction is not less than 8 kgf/mm$^2$.

5. The thermal transfer printing film according to claim 1, wherein the alkoxysilane is methyltrimethoyxsilane, methyltriethoxysilane, methyltripropoxysilane, ethyltrimethoxysilane, vinyltrimethoxysilane, phenyltrimethoxysilane, 3-aminopropyltrimethoxysilane, 3-mercaptopropyltrimethoxysilane or dimethyldimethoxysilane.

6. The thermal transfer printing film according to claim 1, wherein colloidal silica is contained in an amount of 80 to 9% by weight, as solid content of silica, to 20 to 100% by weight of the alkoxysilane hydrolyzate.

7. The thermal transfer printing film according to claim 1, wherein the stick-preventing layer is made of a mixture of alkoxysilane hydrolyzate and melamine resin in a 1:0–50 by solid weight ratio.

8. The thermal transfer printing film according to claim 1, wherein the stick-preventing layer contains an antistatic agent.

9. The thermal transfer printing film according to claim 1, wherein the stick-preventing layer contains a surface active agent.

* * * * *